US011857126B2

(12) United States Patent
Bing et al.

(10) Patent No.: US 11,857,126 B2
(45) Date of Patent: Jan. 2, 2024

(54) THEFT DETERRENT DISPENSER AND MOUNTING ASSEMBLY

(71) Applicant: Cintas Corporate Services, Inc., Cincinnati, OH (US)

(72) Inventors: Richard R. Bing, West Chester, OH (US); Megan Kathryn Helms, Hamilton, OH (US); David Steven Mesko, Wyoming, OH (US); Michael E. Berger, Brooklyn, NY (US); Adem Önalan, Jersey City, NJ (US); Marco C. Perry, Brooklyn, NY (US)

(73) Assignee: Cintas Corporate Services, Inc., Cincinnati, OH (US)

( * ) Notice: Subject to any disclaimer, the term of this patent is extended or adjusted under 35 U.S.C. 154(b) by 5 days.

(21) Appl. No.: 17/473,091

(22) Filed: Sep. 13, 2021

(65) Prior Publication Data

US 2022/0167802 A1 Jun. 2, 2022

Related U.S. Application Data

(60) Provisional application No. 63/119,820, filed on Dec. 1, 2020.

(51) Int. Cl.
*A47K 5/12* (2006.01)

(52) U.S. Cl.
CPC ..... *A47K 5/1205* (2013.01); *A47K 2201/02* (2013.01)

(58) Field of Classification Search
CPC .... B65D 23/003; B65D 51/242; B60N 3/105; B60N 3/106; B05B 11/3045; B05B 11/3047; A47K 5/12; A47K 2201/00; A47K 5/1205; A47K 2201/02
USPC ..... 222/181.3; 248/311.2
See application file for complete search history.

(56) References Cited

U.S. PATENT DOCUMENTS 2,583,688 A * 1/1952 Dobkin ..... A47K 5/1204 222/320
2,883,139 A * 4/1959 Dobkin ..... A47J 47/16 248/311.2
5,758,853 A * 6/1998 Perrin ..... A47K 5/12 248/311.2
6,962,272 B2 11/2005 LeBlond
(Continued)

FOREIGN PATENT DOCUMENTS

WO WO-2020110033 A2 * 6/2020 ..... A47K 5/1205

*Primary Examiner* — Vishal Pancholi
*Assistant Examiner* — Robert K Nichols, II
(74) *Attorney, Agent, or Firm* — Wood Herron & Evans LLP

(57) ABSTRACT

A dispenser bottle containing liquid may be mounted to a wall by a mounting assembly including a base and a carriage plate. Amounting bracket may be anchored to the wall and the carriage plate is coupled to the mounting bracket and is spring biased toward an extended configuration relative to the mounting bracket. A release pin maintains the carriage plate and base in a retracted configuration. A collar projects from an upper end of the mounting bracket to capture a neck of the bottle. A projection extends upwardly from the base and into a socket on the bottom of the bottle when seated on the base. The combination of the mating socket and projection at the base and the collar around the neck of the bottle inhibits removal of the bottle from the mounting assembly when in the retracted configuration.

18 Claims, 20 Drawing Sheets

(56) References Cited

U.S. PATENT DOCUMENTS

| | | | | |
|---|---|---|---|---|
| 7,770,244 | B2 | 8/2010 | Yeh | |
| 8,020,731 | B2 | 9/2011 | McCullough et al. | |
| 8,365,963 | B2 | 2/2013 | McCullough et al. | |
| 8,893,928 | B2 | 11/2014 | Proper | |
| 10,039,423 | B2 * | 8/2018 | Schultz | A47K 5/12 |
| 10,182,865 | B2 * | 1/2019 | Naga | A61B 18/1815 |
| 2004/0108337 | A1 * | 6/2004 | Makino | A47K 5/12<br>222/183 |
| 2020/0029748 | A1 * | 1/2020 | Bradley | A47K 5/12 |

* cited by examiner

THEFT DETERRENT DISPENSER AND MOUNTING ASSEMBLY

This claims the benefit of U.S. Provisional Patent Application Ser. No. 63/119,820, filed Dec. 1, 2020 and hereby incorporated by reference in its entirety.

BACKGROUND OF THE INVENTION

This invention relates to liquid dispensers, and more particularly to a theft deterrent liquid dispenser and associated mounting assembly.

Many public bathrooms in business establishments such as offices, hotels, theaters, hospitality centers, retail establishments and restaurants have soap, hand sanitizer, hand lotion and other dispensers that include liquid-filled bottles mounted under the counter near a sink. Such dispensers have spouts that are disposed above the counter and are attached to the under-mounted bottles so that soap or other liquid product can be pumped from the bottle. Typically, large holes are bored into the counter so that the spout and bottle can be securely attached to one another to form the dispenser assembly. Such below counter dispensers cannot easily be stolen from the bathroom.

There are several drawbacks to this type of dispenser assembly. First, it is difficult to determine when the under-mounted bottle is empty or running low on product because the bottle is not visible above the counter. Typically, a person has to go underneath the counter and unscrew the bottle to determine the amount of product in it, which is labor-intensive and can be unsanitary. Also, the bottles are typically not disposable and must be refilled with product. The process of pouring fluid product into the bottles can also be labor-intensive and messy.

Many operators of public bathrooms have explored replacing such under counter mounted dispensers as described above with new dispensers that do not have the noted drawbacks. For example, some operators have used stand-alone dispensers that sit on top of, but are not affixed to, the countertop or are mounted on the wall. Those dispensers, however, are often stolen by consumers or others for use elsewhere. Replacement of the stolen dispensers can prove to be very costly for the business and inconvenient and unsanitary for the patron until they are replaced.

Accordingly, there is a need for a liquid dispenser system for public environments that can easily be refilled or replaced and is not prone to theft as with known liquid dispensers.

SUMMARY OF THE INVENTION

These and other shortcomings in the prior art have been addressed and overcome by various embodiments of this invention which is a theft deterrent liquid dispenser, mounting assembly and associated methods of installation and use. This invention in its various embodiments may be utilized with a dispenser for a wide variety of products, including liquid products such as hand sanitizer, soap, lotion, shampoo, conditioner and other liquids capable of being dispensed from a container via a pump mechanism.

In various embodiments, this invention includes a bottle containing liquid to be dispensed from the bottle by a standard pump or other mechanism from an upper end of the bottle. The bottle and pump are mounted to a wall or other surface by a mounting assembly including a base supporting the bottom of the bottle and a mounting bracket projecting upwardly from the base. The mounting bracket may be anchored to the wall or other surface. The mounting assembly also includes in various embodiments a carriage plate coupled to the mounting bracket and spring biased toward an extended configuration relative to the mounting bracket. A release pin and spring assembly maintain the carriage plate in a retracted configuration. A collar projects from an upper end of the carriage plate to surround and capture a neck of the bottle beneath the nozzle of the pump. A projection extends upwardly from the base and into a socket on the bottom of the bottle when seated on the base. The combination of the mating socket and projection at the base and the collar around the neck of the bottle inhibits removal of the bottle from the mounting assembly when in the retracted configuration.

The bottle may be conveniently removed from the mounting system by depressing the release pin with a key, probe or other appropriate tool thereby freeing the carriage plate to slide upwardly relative to the mounting bracket into an extended configuration. Upward movement of the carriage plate disengages the collar from the neck of the bottle and allows a user to pivot or lift the bottom end of the bottle from the base while dipping the nozzle and upper end of the bottle free of the collar.

As such, the dispenser bottle is captured in the mounting assembly in the retracted configuration for use by a patron and to inhibit removal. Moreover, the bottle may be conveniently removed from the mounting assembly for refilling or replacement by proper manipulation of the release pin coupling the mounting bracket and base to the carriage plate.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
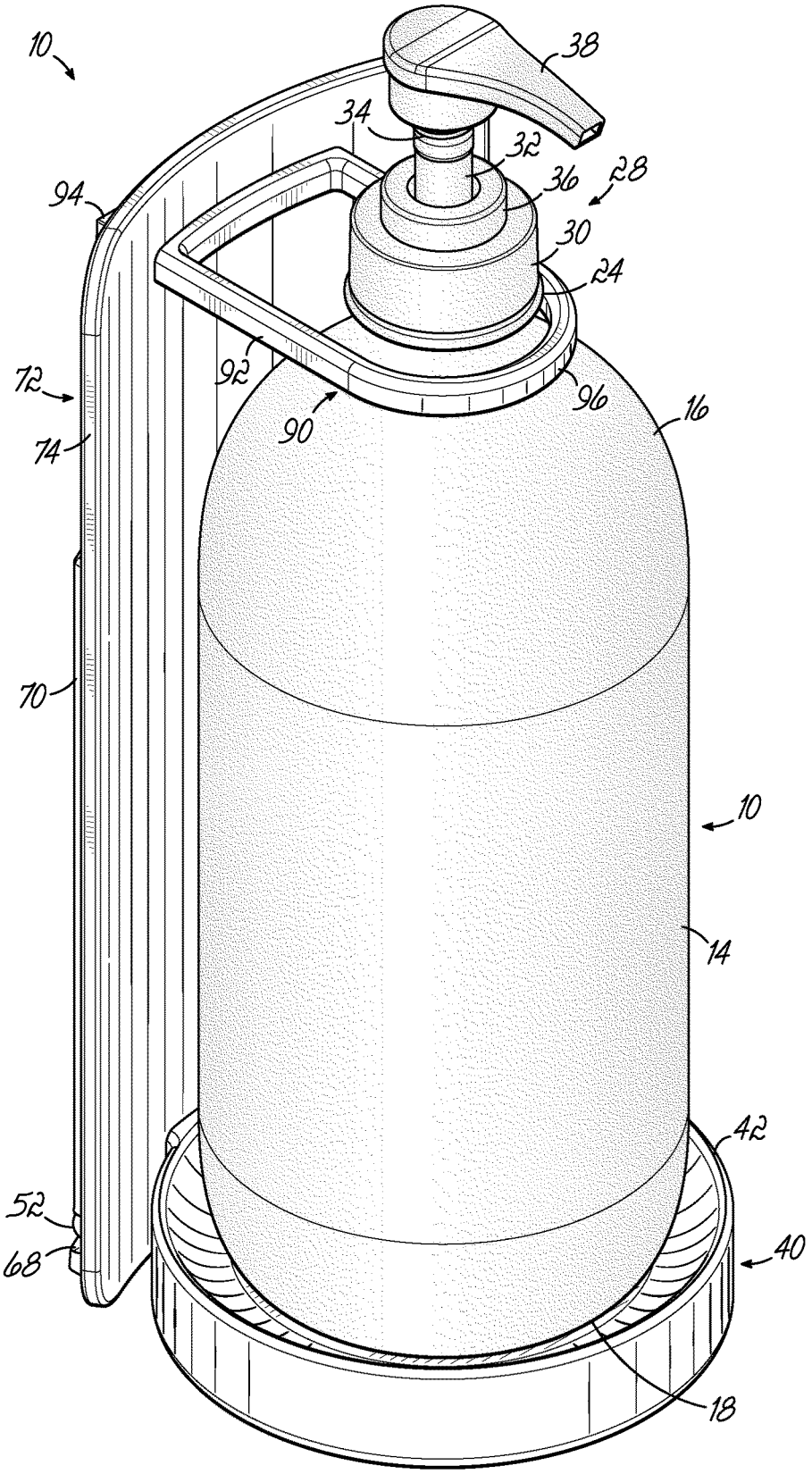
FIG. 1 is a perspective view of one embodiment of a liquid dispenser bottle and mounting assembly in a retracted configuration according to this invention.

Referring to FIG. 1, one embodiment of a dispenser bottle 10 supported on a mounting assembly 12 according to this invention is shown. Further details of the mounting assembly 12 are also shown in FIGS. 2-7B which will aid in disclosure of this embodiment. The dispenser bottle 10 shown in FIG. 1 is exemplary and other dispensers maybe used within the scope of this invention. The dispenser bottle 10 includes a cylindrical sidewall 14 which terminates at an upper shoulder 16 proximate an upper end of the bottle 10 and at a lower bottom 18 at a lower end of the bottle 10. The bottom 18 includes a socket 20 (see FIG. 11B-11C) which in this embodiment is centrally located on the bottom 18 and has a generally cupped, sunken and/or indented configuration. The shoulder 16 narrows to a neck 22 with an outwardly directed rim 24. A mouth (not shown) of the bottle 10 is above the rim 24 and may have an outer thread (not shown) surrounding the mouth of the bottle 10. The outer thread allows for the selective installation of a standard or other liquid pump assembly 28 on the bottle 10. The pump assembly 28 may include an internally threaded flange 30 which mates with the outer thread proximate the mouth of the bottle 10. The pump assembly 28 may have a stem 32 (see FIG. 10C) with an outer thread 34 to selectively enable and disable the pump assembly 28 by releasing from and mating with, respectively, an inner thread (not shown) on a bushing 36 extending upwardly from the flange 30. The stem 32 is in communication with a dip tube (not shown) in the interior of the bottle 10 to draw the liquid from the bottle 10 through the dip tube and stem and out of a dispensing nozzle 38 in response to a downward pumping action as is common with many dispensers well-known in the art. One of ordinary skill in the art will appreciate that other bottle configurations and/or pump assemblies may be utilized within the scope of this invention.

Figure 10A:
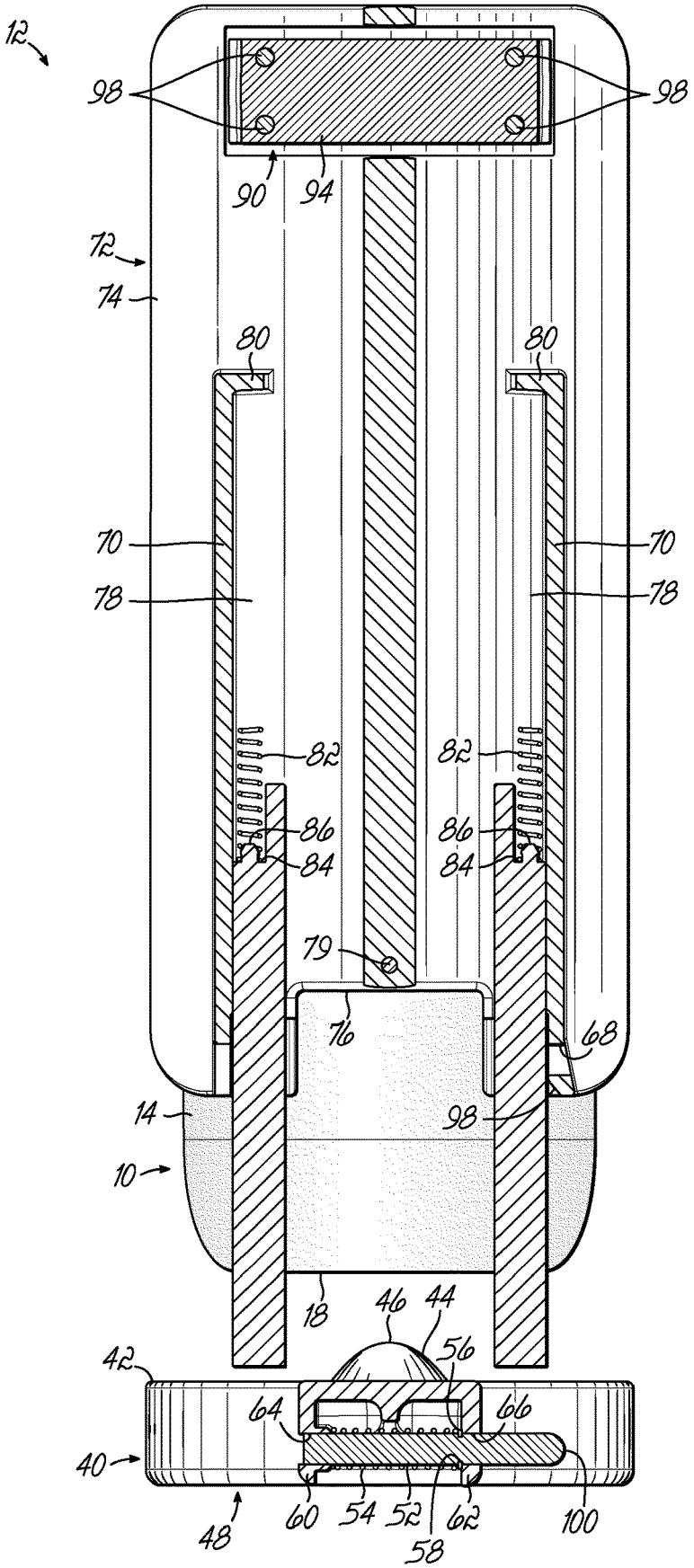
FIG. 10A is a view similar to FIGS. 7A, 8A and 9A of the mounting assembly in the extended configuration.
Figure 10B:
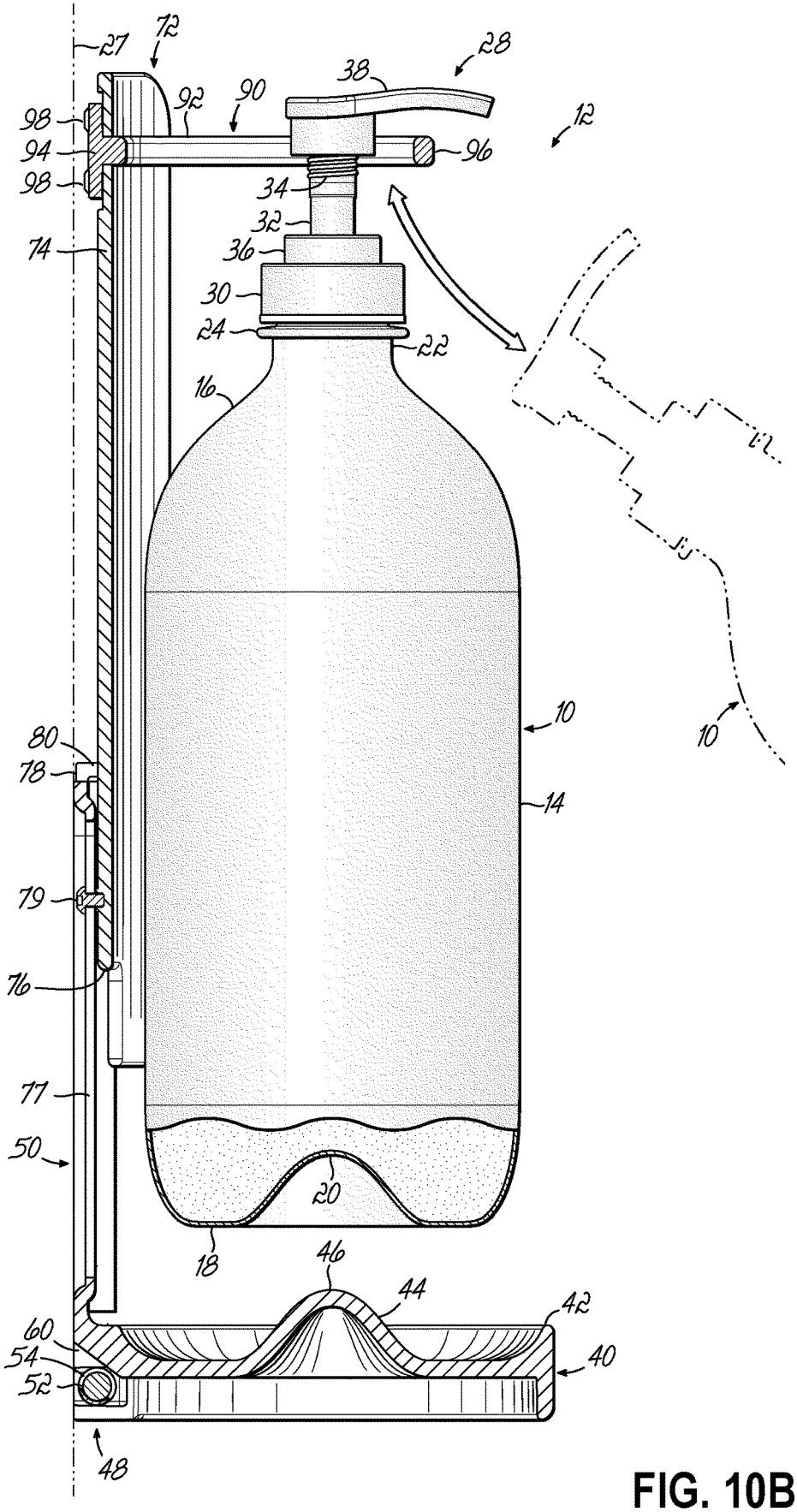
FIG. 10B is a view similar to FIGS. 7B, 8B and 9B of the mounting assembly in the extended configuration with the dispenser bottle sitting on a base of the mounting assembly.

The mounting assembly 12 includes a generally disc shaped base 40 with an upturned peripheral lip 42 and a central projection 44 which is sized, shaped and/or configured to mate with the socket 20 in the bottom 18 of the bottle 10 (see FIG. 10B). The lip 42 surrounds an annular depression 43 which surrounds the projection 44 and may contain fluids dripping from the nozzle 38 or elsewhere. In one embodiment, the projection 44 is a smooth, symmetric mound culminating at an upper tip 46 and fits snuggly within the socket 20 to inhibit movement between the bottom 18 of the bottle 10 and the base 40 when mated therewith. A mounting hub 48 is formed on one side of the base 40 and a mounting bracket 50 extends upwardly from the hub 48. The base 40, mounting hub 48 and mounting bracket 50 may be integrally molded together in one embodiment of this invention. Mounting holes 26 may be provided in the mounting bracket 50 by which the mounting system 12 may be secured to a wall 27 or other surface by fasteners/anchors (not shown).

Figure 2:
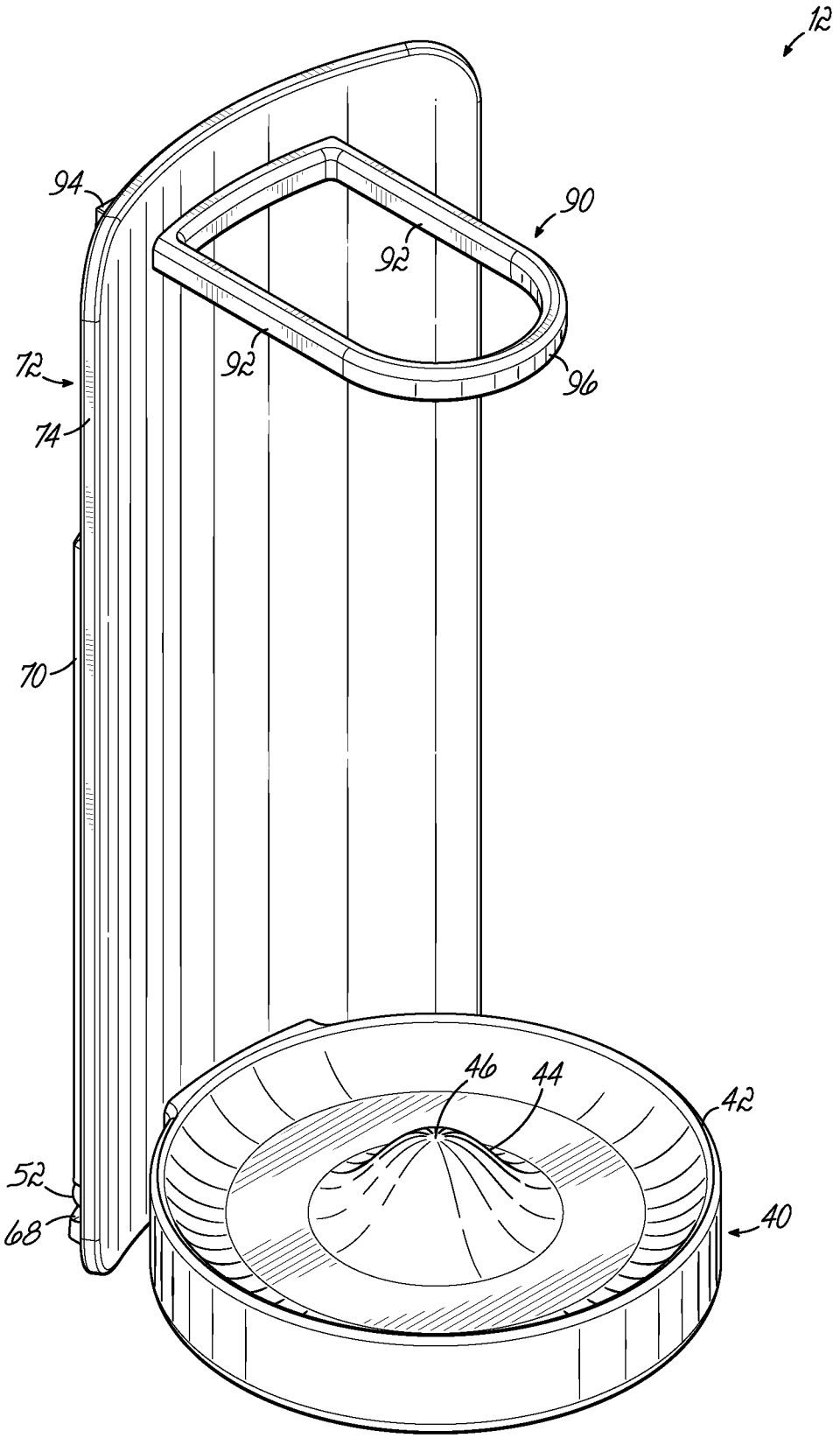
FIG. 2 is a perspective view of the mounting assembly of FIG. 1.
Figure 3:
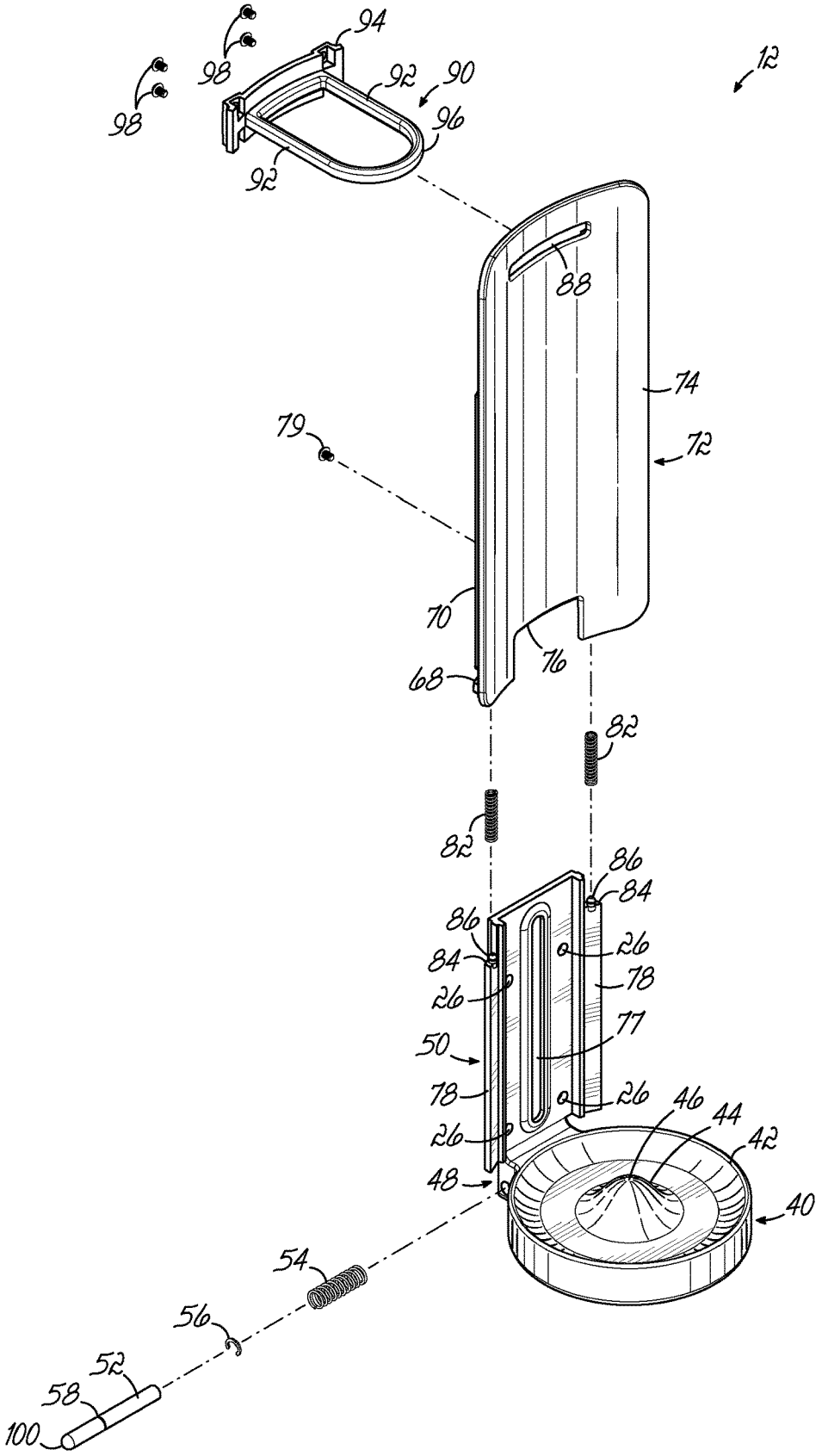
FIG. 3 is an exploded view of the components of the mounting assembly of FIGS. 1-2.
Figure 4:
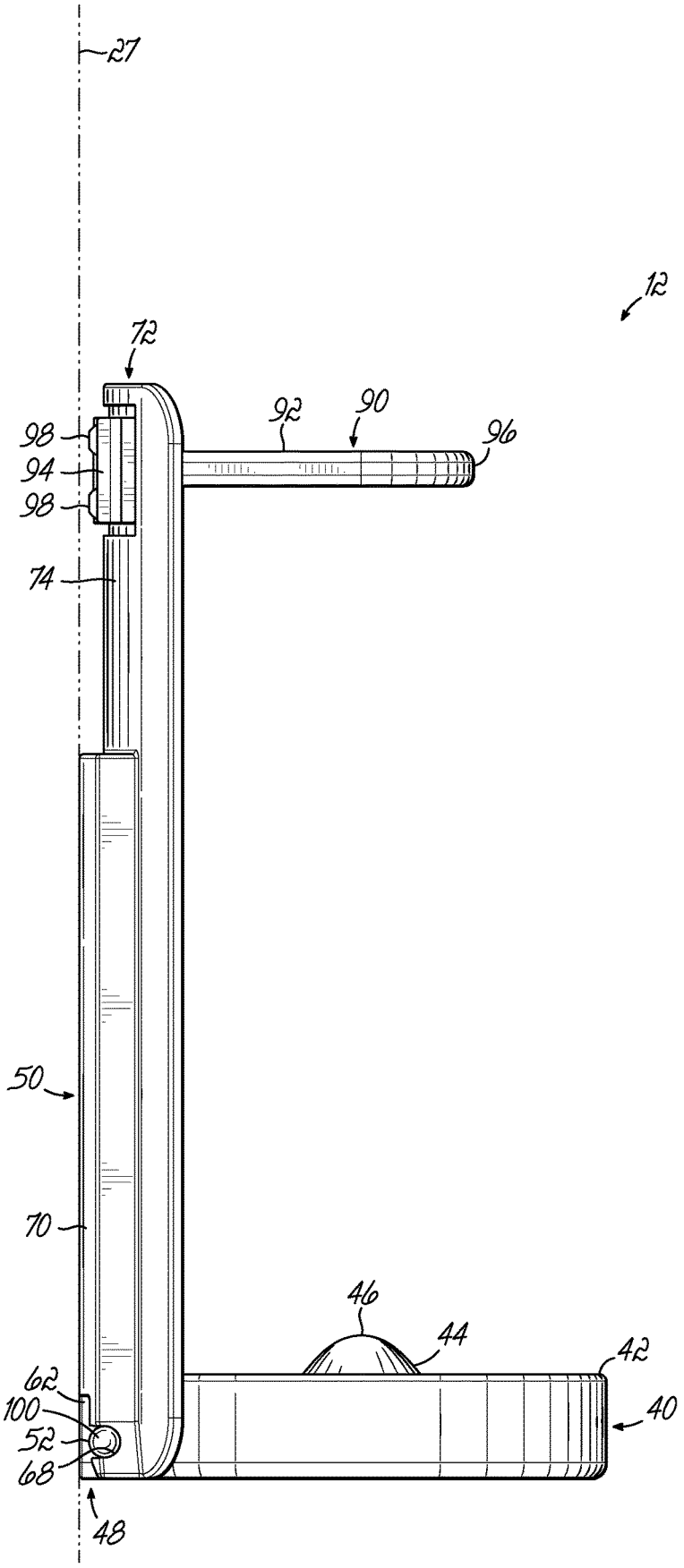
FIG. 4 is a side elevational view of the mounting assembly of FIGS. 1-2.
Figure 5:
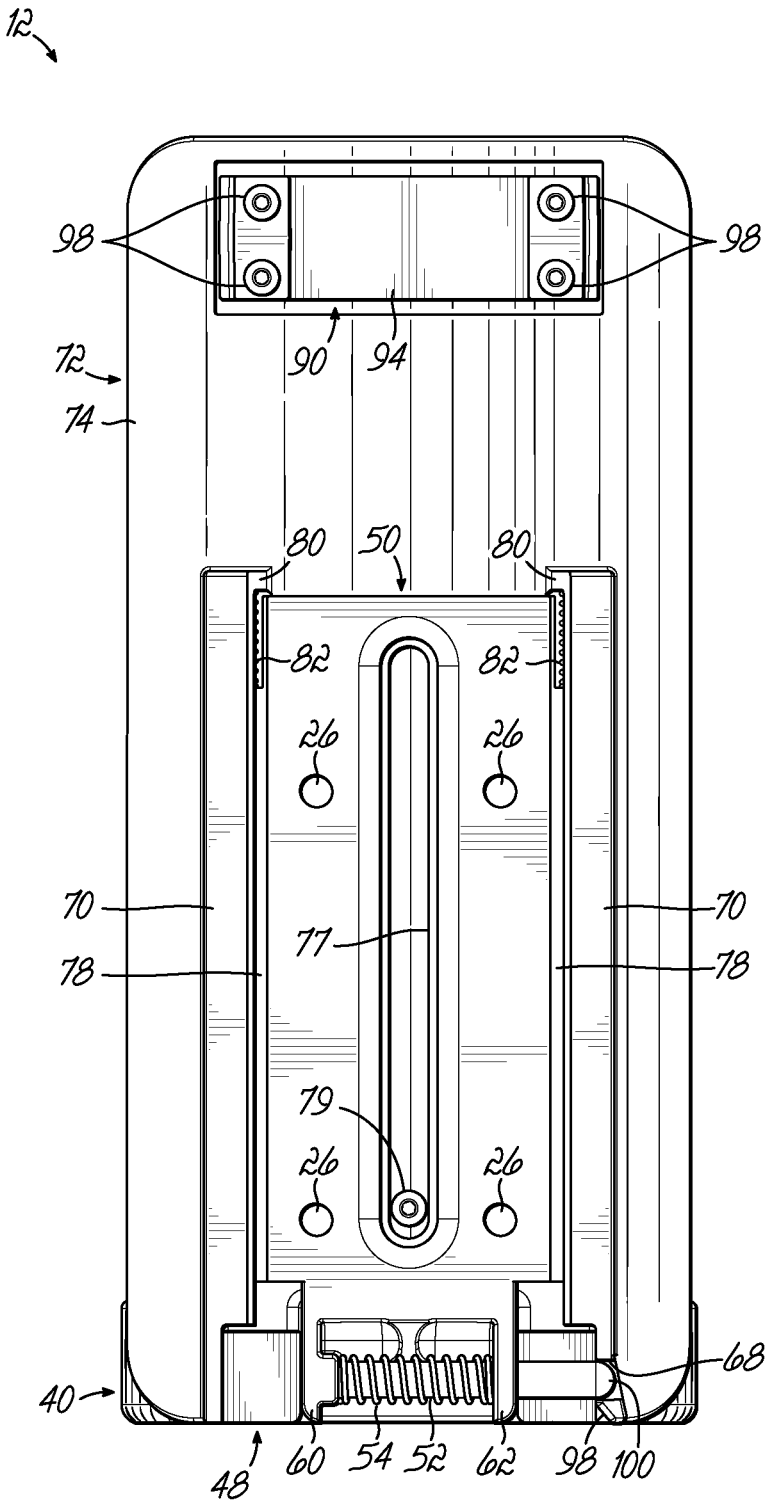
FIG. 5 is a rear elevational view of the mounting assembly of FIGS. 1, 2 and 4.
Figure 6:
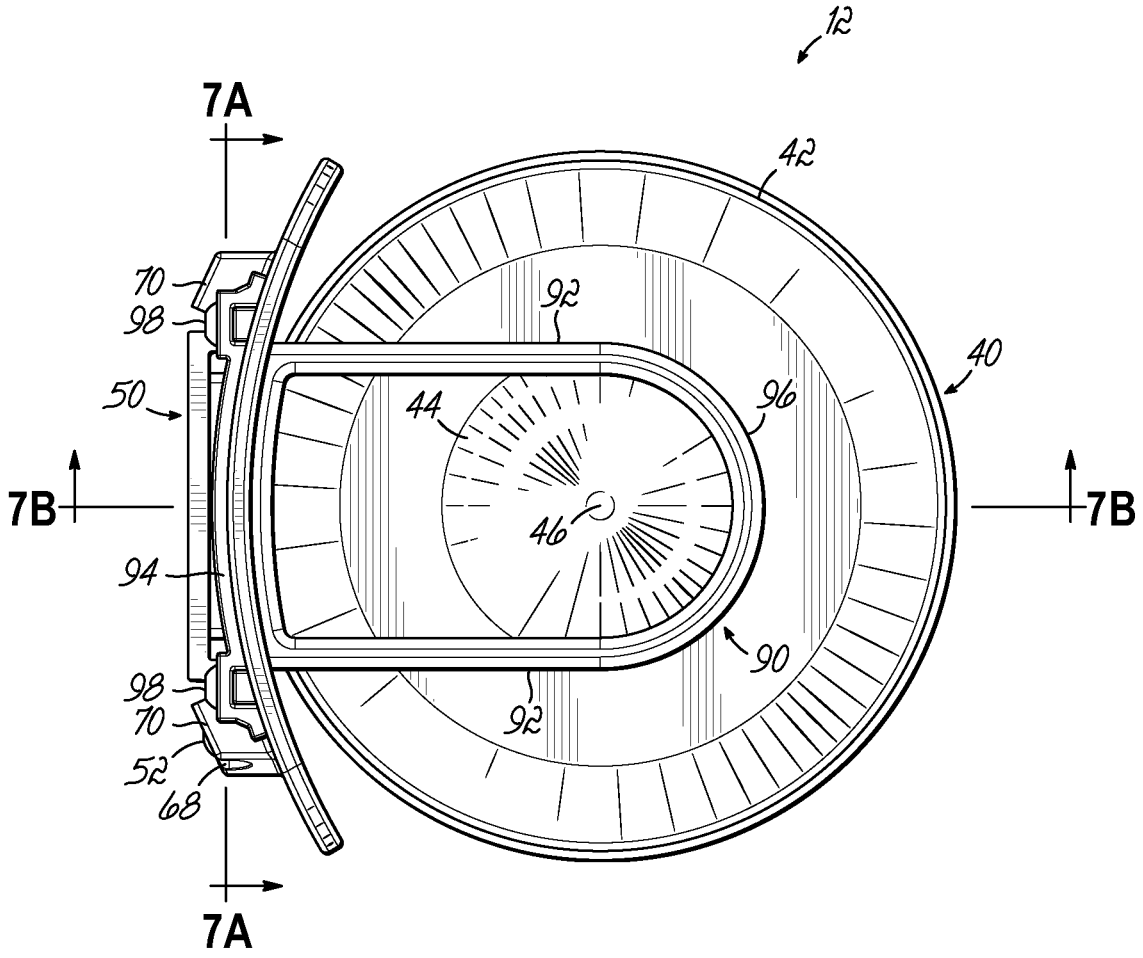
FIG. 6 is a top view of the mounting assembly of FIGS. 1-2 and 4-5.
Figure 7A:
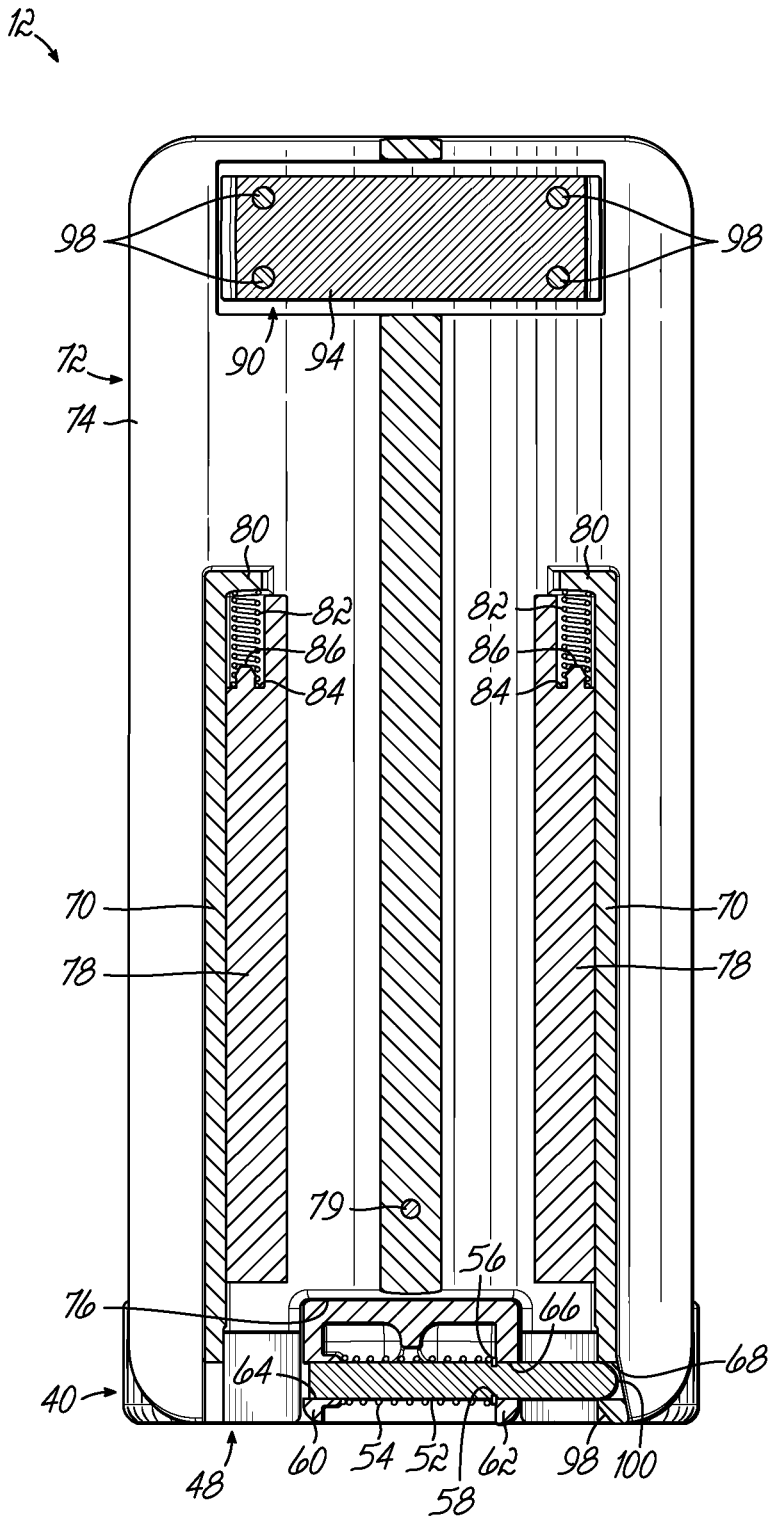
FIG. 7A is a cross-sectional view of the mounting assembly taken along line 7A-7A of FIG. 6.
Figure 7B:
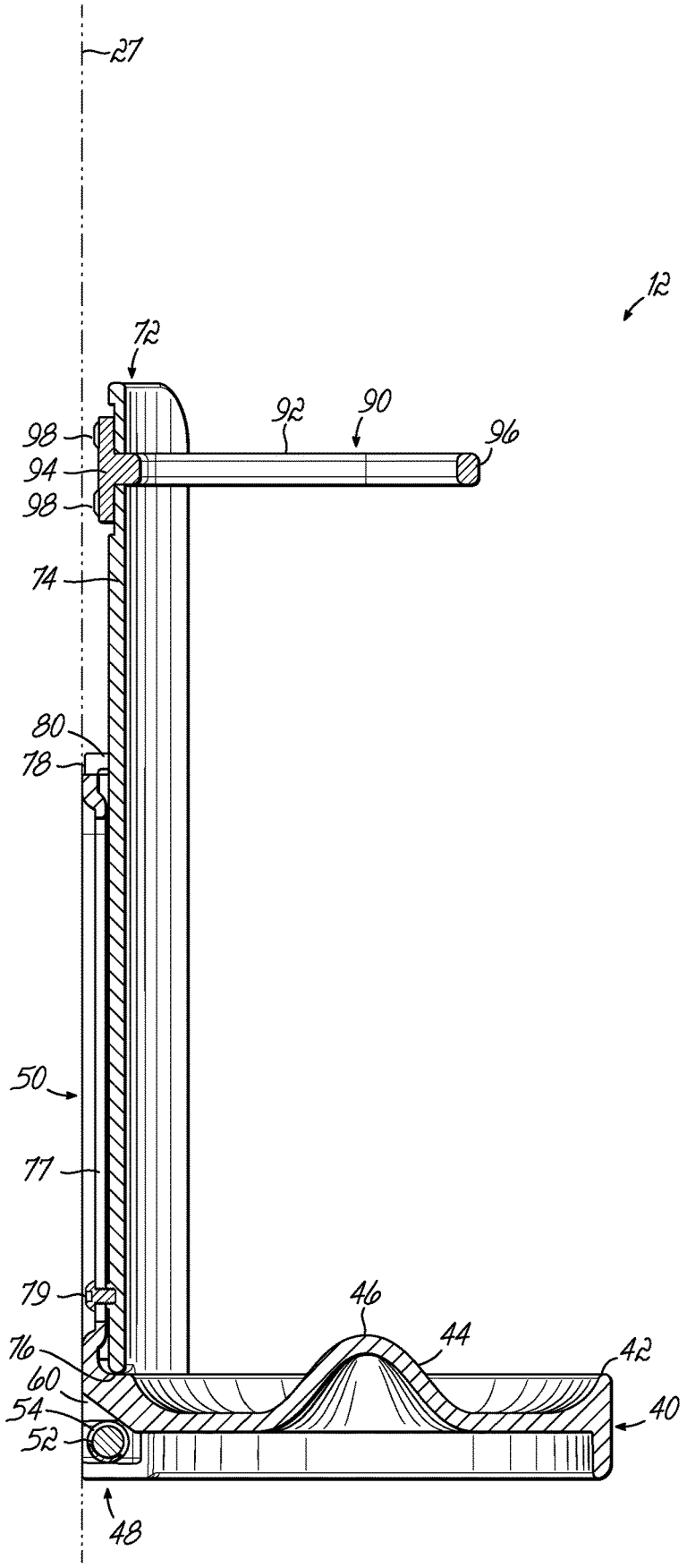
FIG. 7B is a cross-sectional view of the mounting assembly taken along line 7B-7B of FIG. 6.

A release mechanism may include a pin 52 and a release spring 54 captured in the hub 48 by a ring clip 56 seated in a groove 58 on the pin 52. The release spring 54 is seated between a pair of downwardly depending arms 60, 62 and surrounds the release pin 52 as shown in FIG. 5. The pin 52 is mounted to translate through holes 64, 66 in the arms 60, 62, respectively. The spring 54 biases the pin 52 to project from the hole 66 in the arm 62 and into an aperture 68 in a lower end of one of two slides 70 projecting rearwardly from a carriage member which in one embodiment is a carriage plate 72 coupled to the mounting bracket 50. The carriage plate 72 has an arcuate shield 74 confronting the bottle 10 when seated on the base 40. The carriage plate 72 and mounting bracket 50, with the base 40 connected thereto, are coupled together to allow for vertical movement relative to each other. A notch 76 is formed in a bottom edge of the shield 74 to allow for the hub 48 to seat within the notch 76 when the mounting assembly 12 is in a retracted configuration as shown in FIGS. 1, 2, and 4 among others. The mounting bracket 50 may include a central longitudinal channel 77 which is adapted to receive a set screw 79 secured into the back of the carriage plate 72 to guide the vertical movement of the carriage plate 72 relative to the mounting bracket 50.

Figure 10C:
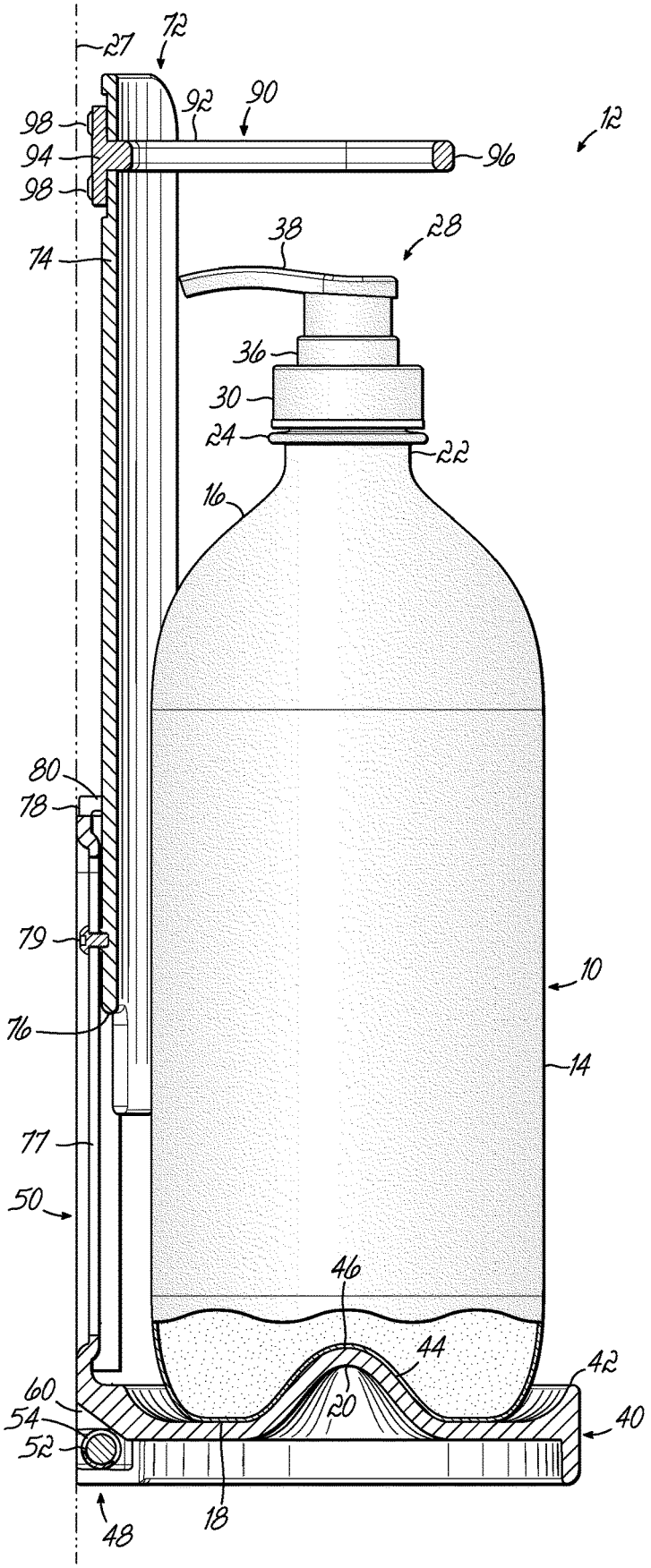
FIG. 10C is a view similar to FIG. 10B with the dispenser bottle being installed or removed from the mounting assembly.

The release pin 52 projects into the aperture 68 to releasably retain the mounting assembly 12 in the retracted configuration. The slides 70 on the carriage plate 72 cooperate with a pair of rails 78 on the mounting bracket 50 to guide the movement of the carriage plate 72 relative to the mounting bracket 50 and base 40 to and from the retracted configuration. The rails 78 are both situated between the slides 70 with each rail 78 mounted against one of the slides 70 (see FIG. 7A). Each slide 70 has an inwardly oriented brace 80 at an upper end thereof. A pair of compression springs 82 are each compressed between one of the braces 80 and an abutment 84 having a lug 86 projecting upwardly into the interior of the associated compression spring 82 when the mounting assembly 12 is in the retracted configuration. The compression springs 82 bias the carriage plate 72 upwardly from the retracted configuration toward an extended configuration as shown in FIGS. 10A-10C at which each compression spring 82 disengages from the associated brace 80 on the slides 70 while remaining on the lug 86 and abutment 84 of the rail 78.

Figure 13A:
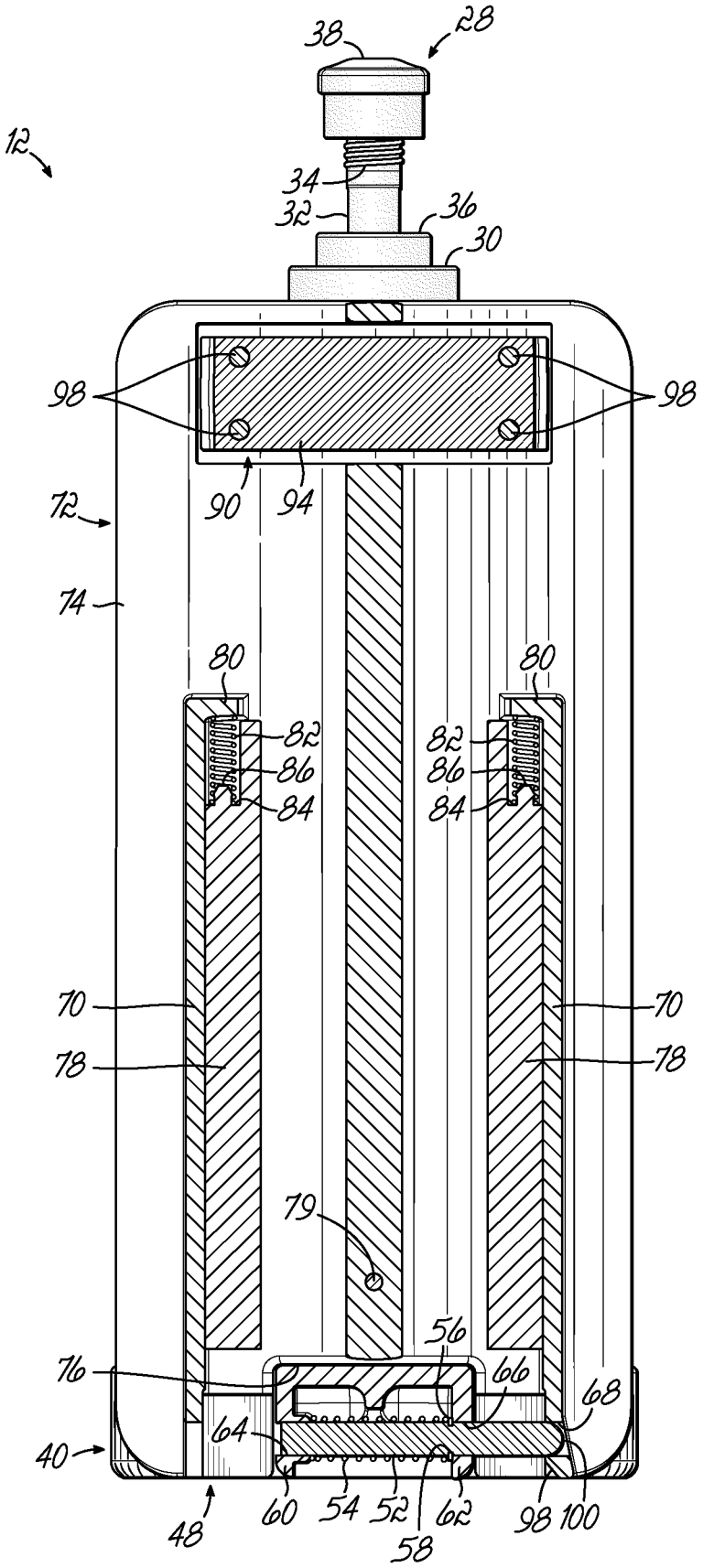
FIG. 13A is a view similar to FIGS. 7A, 8A, 9A, 10A and 11A of the mounting assembly in the extended configuration with the dispenser bottle.
Figure 13B:
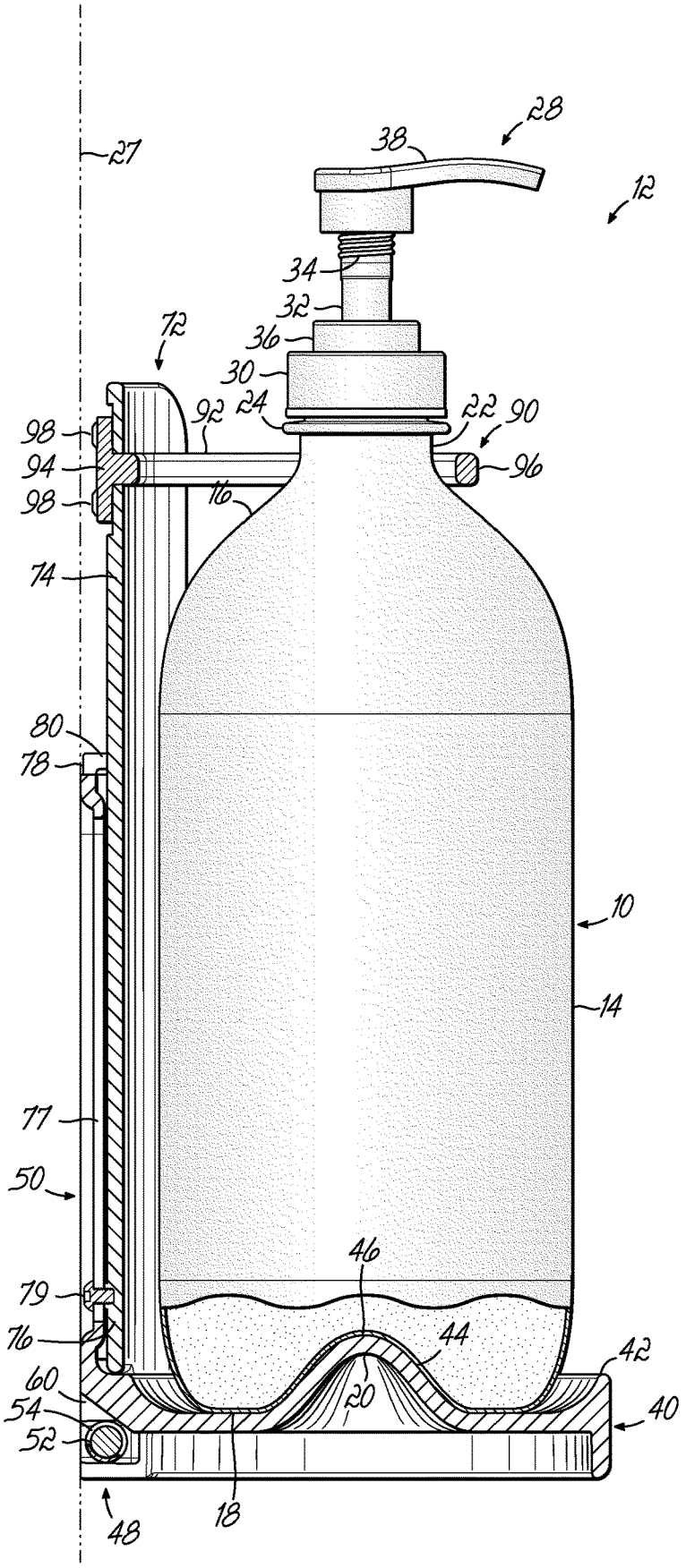
FIG. 13B is a view similar to FIGS. 7B, 8B, 9B, 10B and 11B of the mounting assembly in the retracted configuration supporting the dispenser bottle.

The shield 74 includes a slot 88 proximate an upper end thereof which is sized and configured to allow a retainer, which in one embodiment is a collar 90 to extend therethrough as shown in FIGS. 1-4. The collar 90 has a pair of legs 92 each extending from a mounting plate 94 and joined together at an arcuate distal portion 96. The mounting plate 94 is mounted to a backside of the shield 74 by mounting screws 98 and the legs 92 and arcuate distal portion 96 project through the slot 88 as shown in FIG. 4. When the mounting assembly 12 is in the retracted configuration with the bottle 10 supported on the base 40, the collar 90 captures and retains the neck 22 of the bottle 10 as shown in FIGS. 1 and 13B. The combination of the collar 90 around the neck 22 and the projection 44 seated into the socket 20 at the bottom 18 of the bottle 10, inhibits and/or prevents removal of the bottle 10 from the mounting assembly 12 when in the retracted configuration.

As such, the mounting assembly 12 deters theft of the bottle 10 and its contents when in the retracted position thereby limiting the added expense and inconvenience of replacing a stolen bottle 10. The bottle 10 cannot be pulled upwardly from the base 40 due to the collar 90 secured around the neck 22 and/or pump assembly 28 of the bottle 10. Moreover, the bottom 18 of the bottle 10 cannot be pivoted, rotated or translated off of the base 40 due to the fit between the projection 44 inserted into the socket 20 on the bottom 18 of the bottle 10 which maintains the positional relationship between the bottle 10 and the base 40.

Figure 8A:
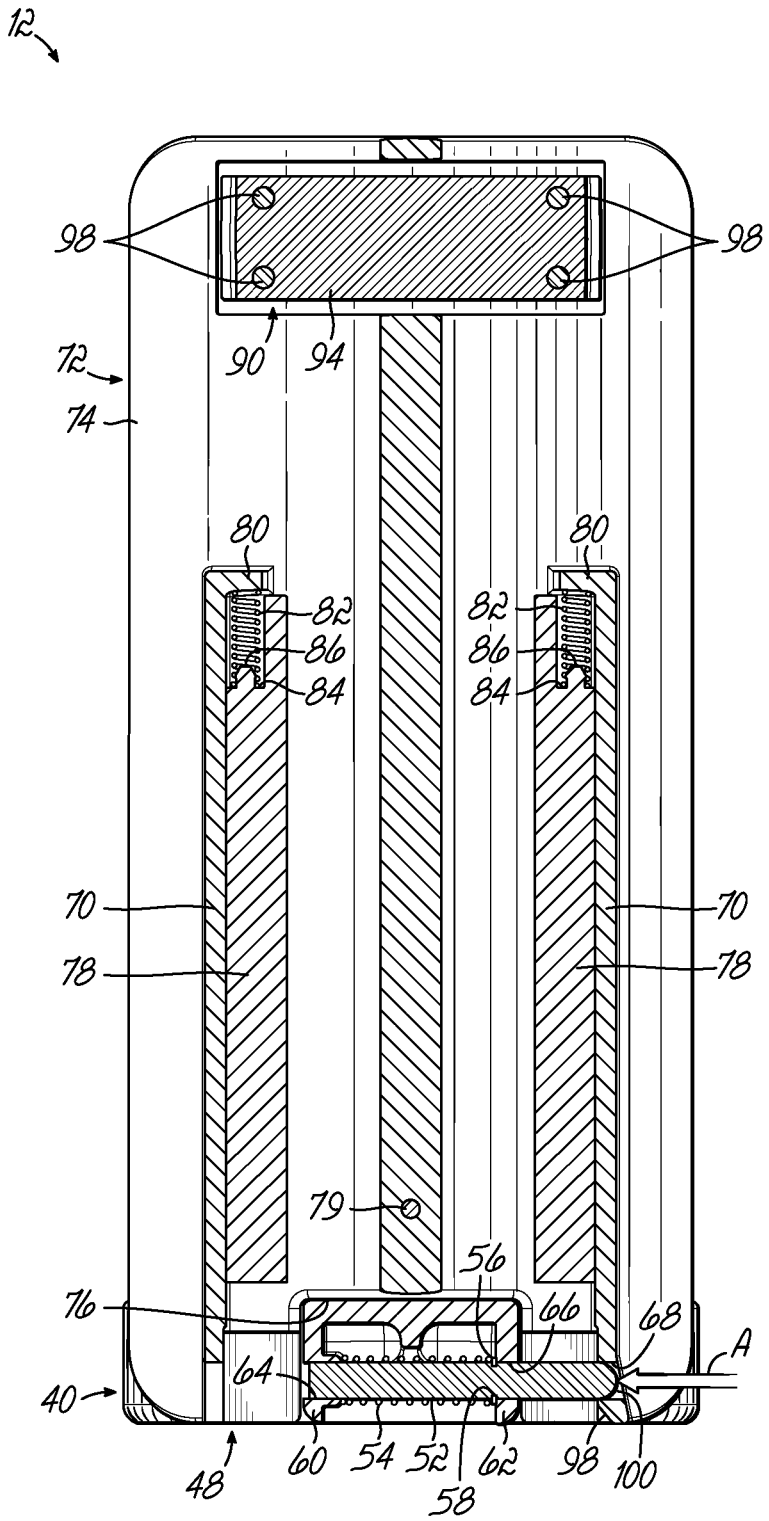
FIG. 8A is a view similar to FIG. 7A with the mounting assembly being released from the retracted configuration.
Figure 8B:
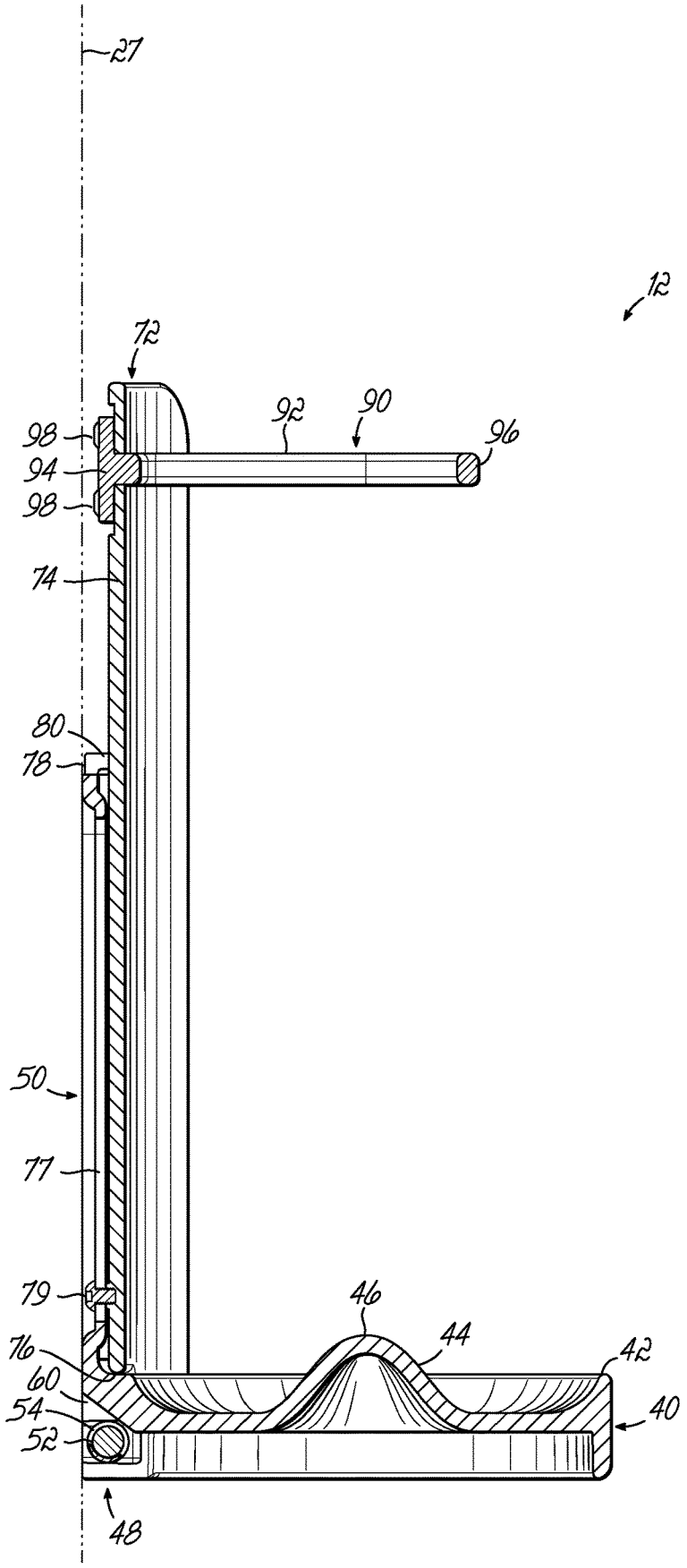
FIG. 8B is a view similar to FIG. 7B with the mounting assembly being released from the retracted configuration.
Figure 9A:
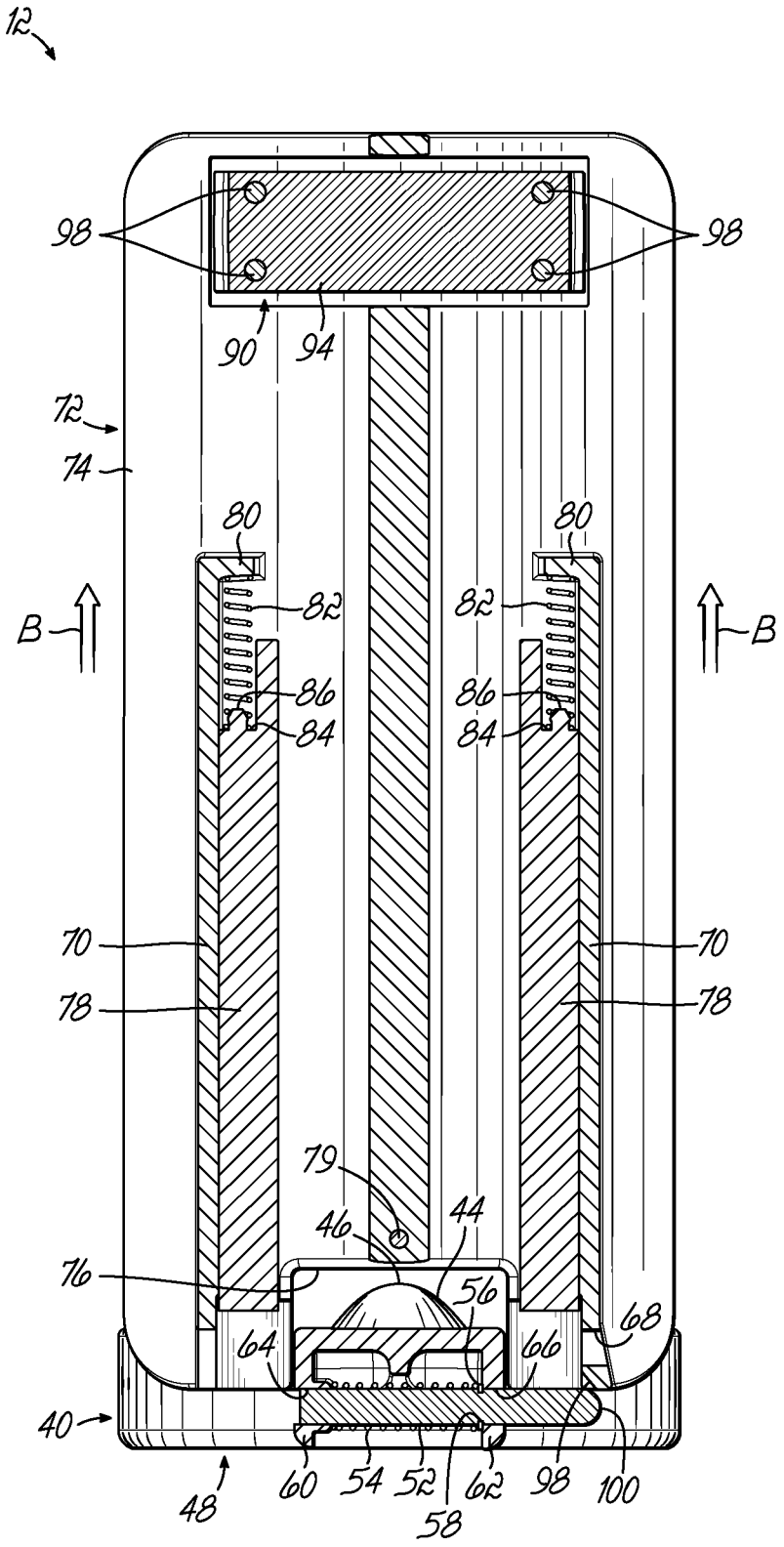
FIG. 9A is a view similar to FIGS. 7A and 8A of the mounting assembly moving toward an extended configuration.
Figure 9B:
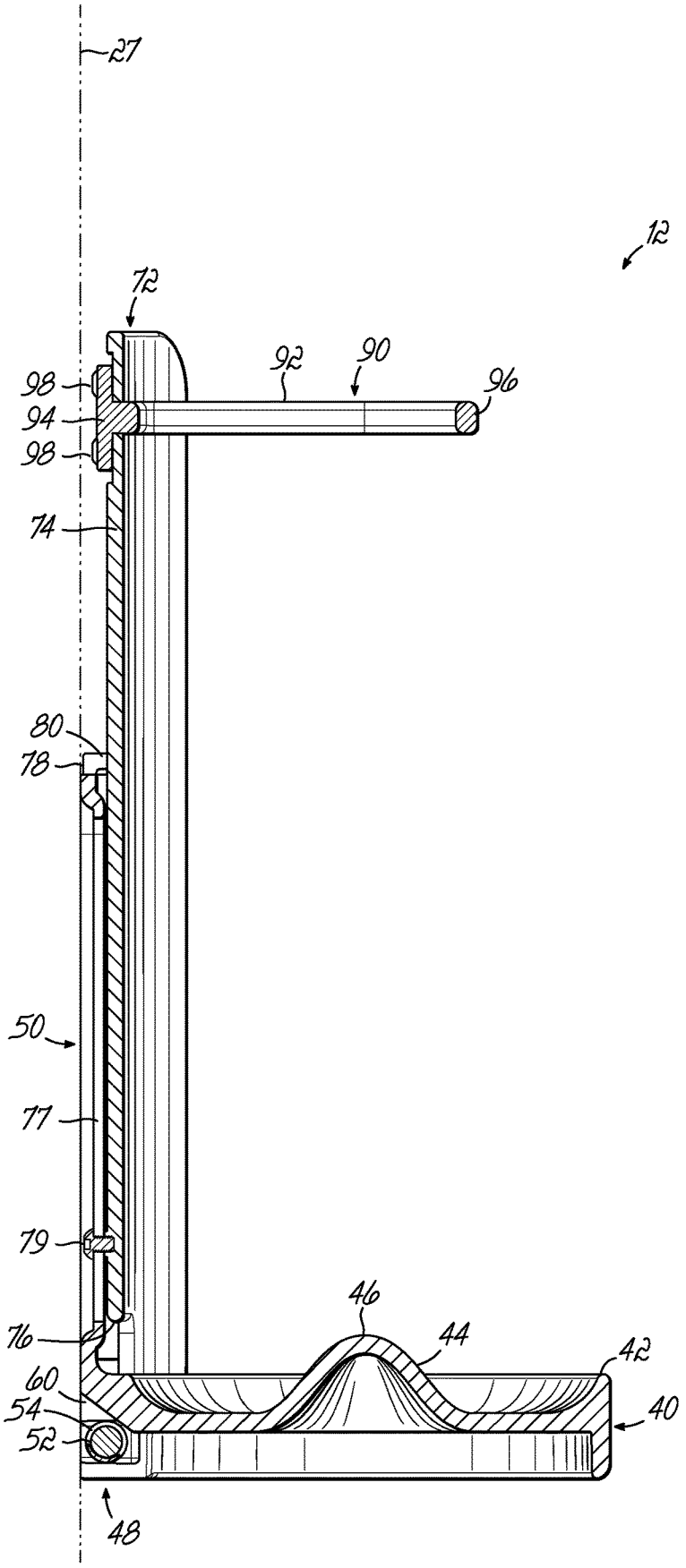
FIG. 9B is a view similar to FIGS. 7B and 8B of the mounting assembly moving toward the extended configuration.

The bottle 10 may be conveniently removed from the mounting system 12 when in the extended configuration for replacement, cleaning, inspection or refilling of the bottle 10. To convert the mounting system 12 from the retracted configuration to the extended configuration, an authorized user may insert a probe, key or other tool (not shown) in the direction of arrow A of FIG. 8A into the hub 48 and contact the release pin 52 and actuate the release mechanism. Continued insertion of the tool in the direction of arrow A against the pin 52 while translating the pin 52 against the bias of the release spring 54 and further into the hub 48 thereby removes the pin 52 from the aperture 68 in the slide 70 of the carriage plate 72. When the tool is then removed, the compression springs 82 push the carriage plate 72 upwardly in the direction of arrows B in FIG. 9A. Once the aperture 68 in the slide 70 is raised out of alignment with the axis of the release pin 52, the release spring 54 extends the pin 52 to be positioned below and disengaged from the slide 70. The interaction of the slides 70 and the respective rails 78 as well as the set screw 79 in the channel 77 guide the movement of the carriage plate vertically upward relative to the mounting bracket 50 and base 40 supporting the bottle 10. Manual upward movement of the carriage plate 72 relative to the base 40 may be necessary beyond the extent of the compression springs 82 so that the collar 90 clears the nozzle 38 of the bottle 10 as shown in FIG. 10B resulting in the mounting system 12 in the extended configuration. The bottle 10 may then be easily removed and/or reinstalled from/onto the mounting system 12 as shown in FIG. 10C.

Figure 11A:
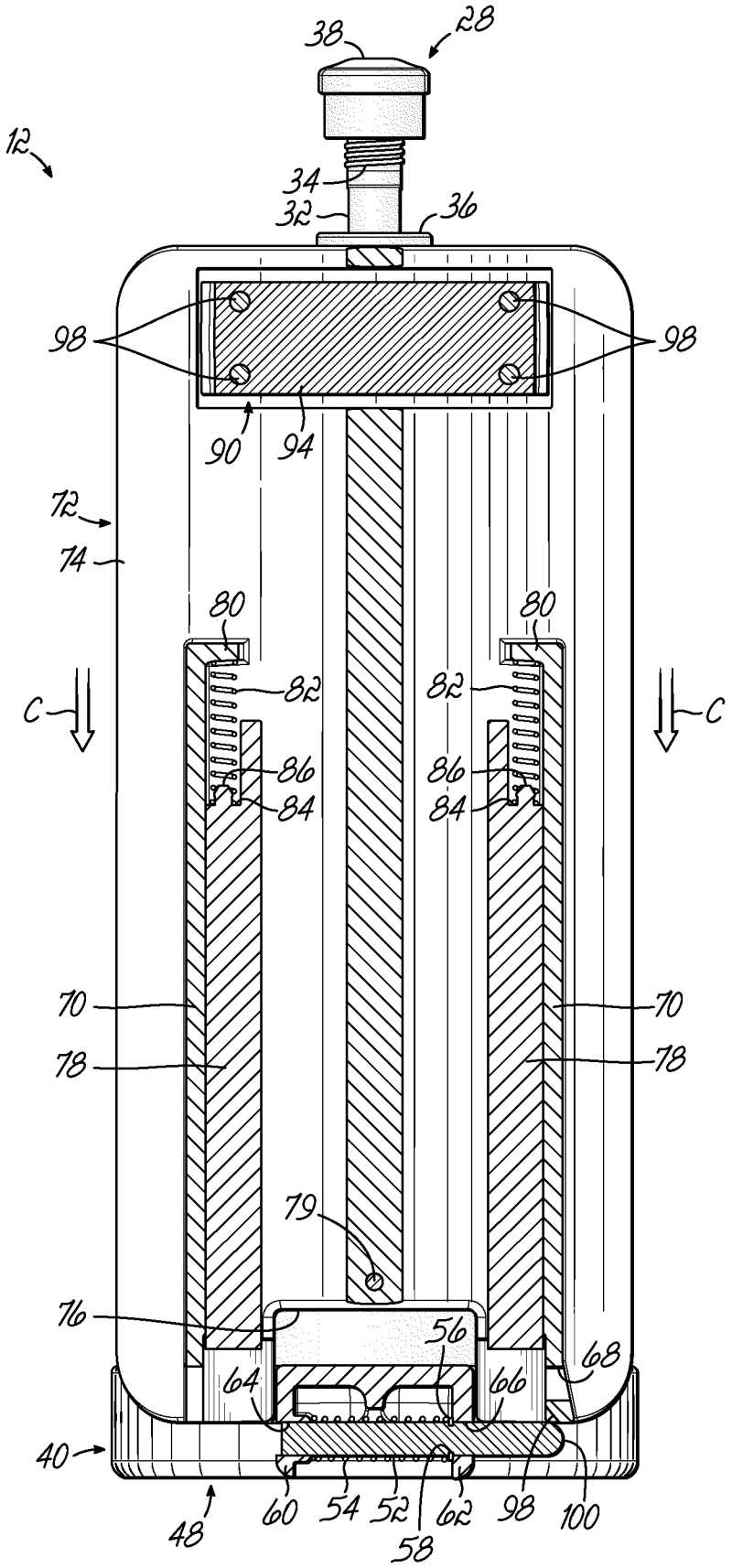
FIG. 11A is a view similar to FIGS. 7A, 8A, 9A and 10A of the mounting assembly moving from the extended configuration toward the retracted configuration.
Figure 11B:
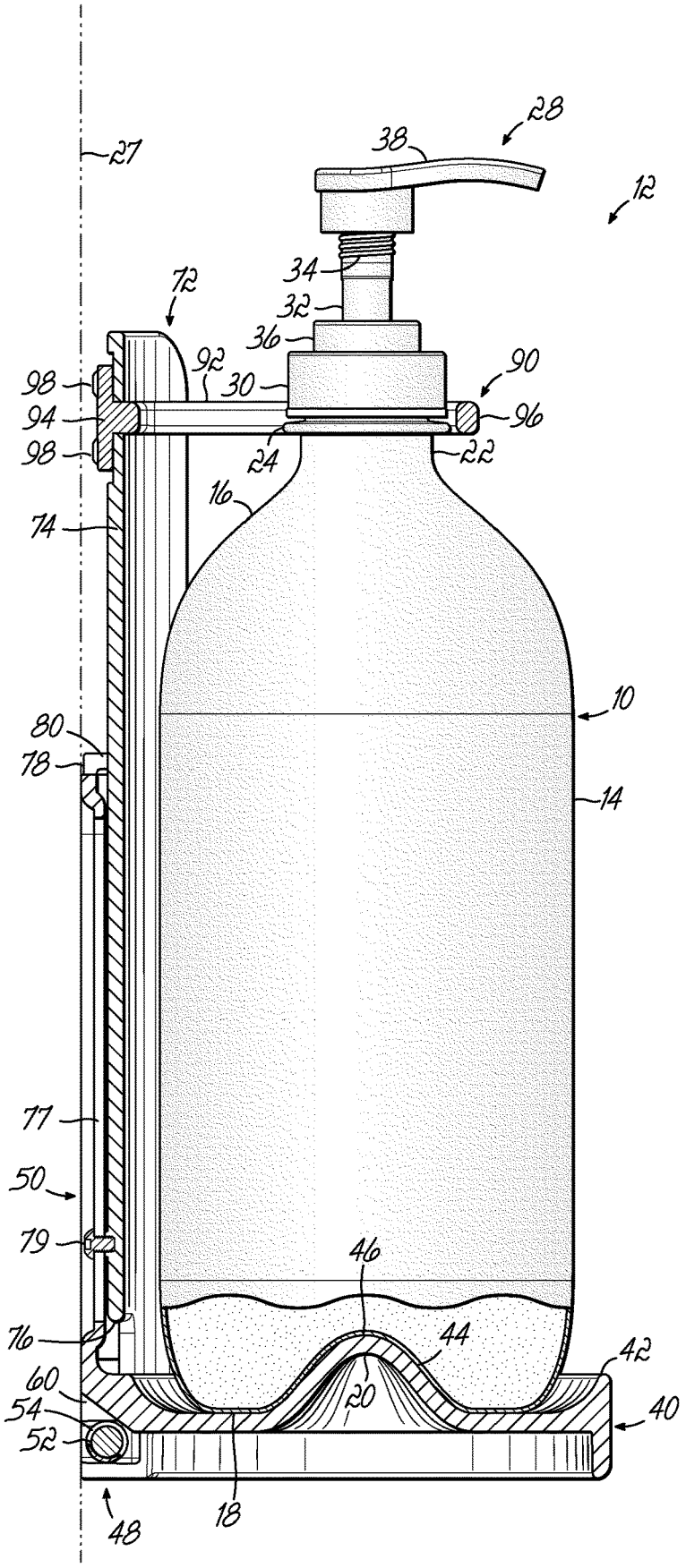
FIG. 11B is a view similar to FIGS. 7B, 8B, 9B and 10B of the mounting assembly moving from the extended configuration toward the retracted configuration.
Figure 12:
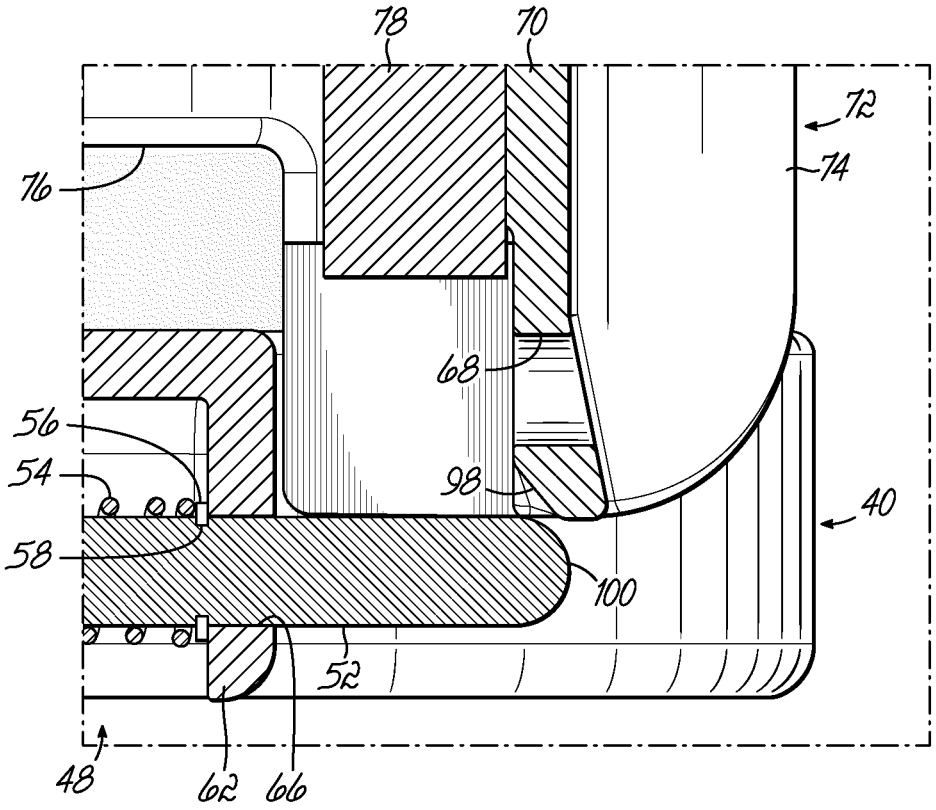
FIG. 12 is an enlarged view of a portion of FIG. 11A.

The mounting system 12 may be returned to the retracted configuration from the extended configuration with the bottle 10 supported on the base 40 as shown in FIGS. 11A-11B according to one aspect of this invention. The carriage plate 72 is pushed downwardly in the direction of arrows C in FIG. 11A so that the collar 90 clears the nozzle 38 and approaches the neck 22 of the bottle 10 (FIG. 11B). The orientation of the nozzle 38 may need to be adjusted for insertion into and through the collar 90. Downward movement of the carriage plate 72 reengages the braces 80 on the rails 78 with the compression springs 82. Continued downward movement of the carriage plate 72 compresses the springs 82 against the abutments 84 on the rails 78 until the lower end of the rail 78 proximate the release pin 52 engages the pin 52. A tapered edge 98 (see FIG. 12) at the end of the rail 78 contacts a rounded end 100 of the pin 52 and urges the pin 52 into the hub 48 against the bias of the release spring 54 until the pin 52 is aligned with the aperture 68 in the rail 78 which allows the spring 54 to urge the pin 52 into the aperture 68 thereby releasable securing the mounting system 12 in the retracted position (see FIGS. 13A-13B).

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. A liquid dispenser assembly comprising:

a dispensing bottle containing a liquid to be dispensed from the dispensing bottle, the dispensing bottle having a longitudinal axis, an upper end and a bottom end;

a pump assembly coupled to the dispensing bottle to pump the liquid from the dispensing bottle, the pump assembly including a nozzle proximate the upper end of the dispensing bottle;

a mounting assembly having a base to support the bottom end of the dispensing bottle, the mounting assembly being movable to and between a retracted configuration and an extended configuration;

a socket formed in the bottom end of the dispensing bottle and centered on the longitudinal axis;

a retainer spaced from the base and positioned proximate the upper end of the dispensing bottle when the mounting assembly is in the retracted configuration; and a projection on the base sized and configured to insert into the socket and centered on the longitudinal axis when the dispensing bottle is supported on the base;

a release mechanism located proximate to the base which when activated allows for the mounting assembly movement confined to a vertical direction from the retracted configuration to the extended configuration;

wherein removal of the dispensing bottle is inhibited by the projection being within the socket and the retainer positioned proximate the upper end of the dispensing bottle when the mounting assembly is in the retracted configuration;

wherein the dispensing bottle may be removed from the mounting assembly with the mounting assembly in the extended configuration.

2. The assembly of claim 1 wherein the retainer further comprises:

a collar capturing the upper end of the dispensing bottle subjacent of the nozzle.

3. The assembly of claim 1 wherein the mounting assembly further comprises:

a carriage member extending upward from base and coupling the retainer, at least in part, to the base.

4. The assembly of claim 1 wherein a distance between the base and the retainer is greater when the mounting assembly is in the extended configuration than when it is in the retracted configuration.

5. The assembly of claim 1 further comprising:

an arcuate shield extending between the base and the retainer.

6. The assembly of claim 1 wherein the mounting assembly is biased toward the extended configuration.

7. The assembly of claim 1 further comprising:

a mounting bracket to secure the mounting assembly to a generally vertical wall surface.

8. A liquid dispenser assembly comprising:

a dispensing bottle containing a liquid to be dispensed from the dispensing bottle, the dispensing bottle having a longitudinal axis, an upper end and a bottom end;

a pump assembly coupled to the dispensing bottle to pump the liquid from the dispensing bottle, the pump assembly including a nozzle proximate the upper end of the dispensing bottle;

a mounting assembly having a base to support the bottom end of the dispensing bottle, the mounting assembly being movable to and between a retracted configuration and an extended configuration;

a socket formed in the bottom end of the dispensing bottle and centered on the longitudinal axis;

a retainer spaced from the base and positioned proximate the upper end of the dispensing bottle when the mounting assembly is in the retracted configuration; and a projection on the base sized and configured to insert into the socket when the dispensing bottle is supported on the base;

a release mechanism located proximate to the base which when activated allows for the mounting assembly movement confined to a vertical direction from the retracted configuration to the extended configuration;

wherein removal of the dispensing bottle is inhibited by the projection being within the socket and the retainer positioned proximate the upper end of the dispensing bottle when the mounting assembly is in the retracted configuration;

wherein the dispensing bottle may be removed from the mounting assembly with the mounting assembly in the extended configuration;

wherein a distance between the base and the retainer is greater when the mounting assembly is in the extended configuration than when it is in the retracted configuration;

wherein the retainer moves upwardly relative to the base when the mounting assembly converts from the retracted configuration to the extended configuration.

9. A liquid dispenser assembly comprising:

a dispensing bottle containing a liquid to be dispensed from the dispensing bottle, the dispensing bottle having a longitudinal axis, an upper end and a bottom end;

a pump assembly coupled to the dispensing bottle to pump the liquid from the dispensing bottle, the pump assembly including a nozzle proximate the upper end of the dispensing bottle;

a mounting assembly having a base to support the bottom end of the dispensing bottle, the mounting assembly being movable to and between a retracted configuration and an extended configuration;

a socket formed in the bottom end of the dispensing bottle and centered on the longitudinal axis;

a retainer spaced from the base and positioned proximate the upper end of the dispensing bottle when the mounting assembly is in the retracted configuration; and a projection on the base sized and configured to insert into the socket when the dispensing bottle is supported on the base;

a release mechanism located proximate to the base which when activated allows for the mounting assembly movement confined to a vertical direction from the retracted configuration to the extended configuration;

wherein removal of the dispensing bottle is inhibited by the projection being within the socket and the retainer positioned proximate the upper end of the dispensing bottle when the mounting assembly is in the retracted configuration;

wherein the dispensing bottle may be removed from the mounting assembly with the mounting assembly in the extended configuration;

the mounting assembly further comprises:

an annular depression surrounding the projection; and a lip surrounding the annular depression, a portion of the bottom of the bottle being seated within the annular depression when the projection is inserted into the socket.

10. A liquid dispenser assembly comprising:

a dispensing bottle containing a liquid to be dispensed from the dispensing bottle, the dispensing bottle having an upper end and a bottom end;

a socket formed in the bottom end of the dispensing bottle;

a pump assembly coupled to the dispensing bottle to pump the liquid from the dispensing bottle, the pump assembly including a nozzle proximate the upper end of the dispensing bottle;

a mounting assembly having a base to support the bottom end of the dispensing bottle, the mounting assembly movement confined to a vertical direction to and between a retracted configuration and an extended configuration;

a collar spaced from the base and positioned proximate the upper end of the dispensing bottle when the mounting assembly is in the retracted configuration, the collar capturing the upper end of the dispensing bottle subjacent of the nozzle;

a projection on the mounting assembly sized and configured to insert into the socket when the dispensing bottle is supported on the base;

wherein removal of the dispensing bottle is inhibited by the projection being within the socket and the collar positioned proximate the upper end of the dispensing bottle when the mounting assembly is in the retracted configuration;

wherein the dispensing bottle may be removed from the mounting assembly with the mounting assembly in the extended configuration;

a carriage member extending upward from base and coupling the collar, at least in part, to the base;

wherein a distance between the base and the collar is greater when the mounting assembly is in the extended configuration than when it is in the retracted configuration;

wherein the collar moves upwardly relative to the base when the mounting assembly converts from the retracted configuration to the extended configuration;

wherein the mounting assembly is biased toward the extended configuration.

11. The assembly of claim 10 wherein the mounting assembly further comprises:

an annular depression surrounding the projection; and a lip surrounding the annular depression, a portion of the bottom of the bottle being seated within the annular depression when the projection is inserted into the socket.

12. The assembly of claim 10 further comprising:

an arcuate shield extending between the base and the retainer.

13. The assembly of claim 10 further comprising:

a release mechanism which when activated allows for the mounting assembly to move from the retracted configuration to the extended configuration.

14. The assembly of claim 10 further comprising:

a mounting bracket to secure the mounting assembly to a generally vertical wall surface.

15. A method for associating a dispensing bottle with a mounting assembly, the method comprising the steps of:

capturing a nozzle proximate an upper end of the dispensing bottle with a retainer extending from the mounting assembly;

pivoting a bottom end of the dispensing bottle toward a generally vertical orientation relative to the upper end of the dispensing bottle;

inserting a projection on one of a base of the mounting assembly and a bottom of the dispensing bottle into a socket formed on the other of the base of the mounting assembly and the bottom end of the dispensing bottle;

collapsing the mounting assembly into a retracted configuration such that removal of the dispensing bottle is inhibited by the projection being inserted within the socket and the retainer positioned proximate the upper end of the dispensing bottle when the mounting assembly is in the retracted configuration;

actuating a release mechanism located proximate to the base to allow for movement of the mounting assembly confined to a vertical direction to and between the retracted configuration and an extended configuration;

removing the dispensing bottle from the mounting assembly by, moving the mounting assembly from the retracted configuration to the extended configuration;

unseating the projection from socket;

tilting the dispensing bottle by pulling the bottom end of the dispensing bottle away from the base; and removing the nozzle from the retainer downwardly.

16. The method of claim 15 wherein the retainer is a collar and the inserting the nozzle step further comprises:

inserting the nozzle into and through the collar extending from the mounting assembly.

17. The method of claim 15 wherein the projection is on the base and the socket is on the bottom of the dispensing bottle.

18. The method of claim 15 wherein the collapsing step further comprises:

moving the retainer closer to the base.

* * * * *